United States Patent [19]

Garcowski

[11] 4,437,614

[45] Mar. 20, 1984

[54] ELECTROSTATIC AIR ATOMIZATION SPRAY COATING SYSTEM

[75] Inventor: Theodore Garcowski, Parma, Ohio

[73] Assignee: Binks Manufacturing Company, Franklin Park, Ill.

[21] Appl. No.: 425,884

[22] Filed: Sep. 28, 1982

[51] Int. Cl.[3] ..... B05B 5/02

[52] U.S. Cl. ..... 239/691; 239/704

[58] Field of Search ..... 239/690, 691, 692, 704, 239/705, 706, 707; 361/227, 228

[56] References Cited

U.S. PATENT DOCUMENTS

| | | | |
|---|---|---|---|
| 2,916,576 | 12/1959 | Croskey et al. | 239/691 X |
| 3,864,603 | 2/1975 | Kozinski et al. | 239/691 X |
| 4,377,838 | 3/1983 | Levey et al. | 361/228 |

*Primary Examiner*—John J. Love
*Assistant Examiner*—Paul A. Sobel
*Attorney, Agent, or Firm*—Gary, Juettner & Pyle

[57] ABSTRACT

An electrostatic air atomization spray coating system having a hand held spray gun, wherein a flow of air to the gun is sensed to control energization of a high voltage power supply for electrostatically charging spray particles, is characterized by a bypass valve on the spray gun which selectively permits air atomization spraying with or without electrostatics.

8 Claims, 1 Drawing Figure

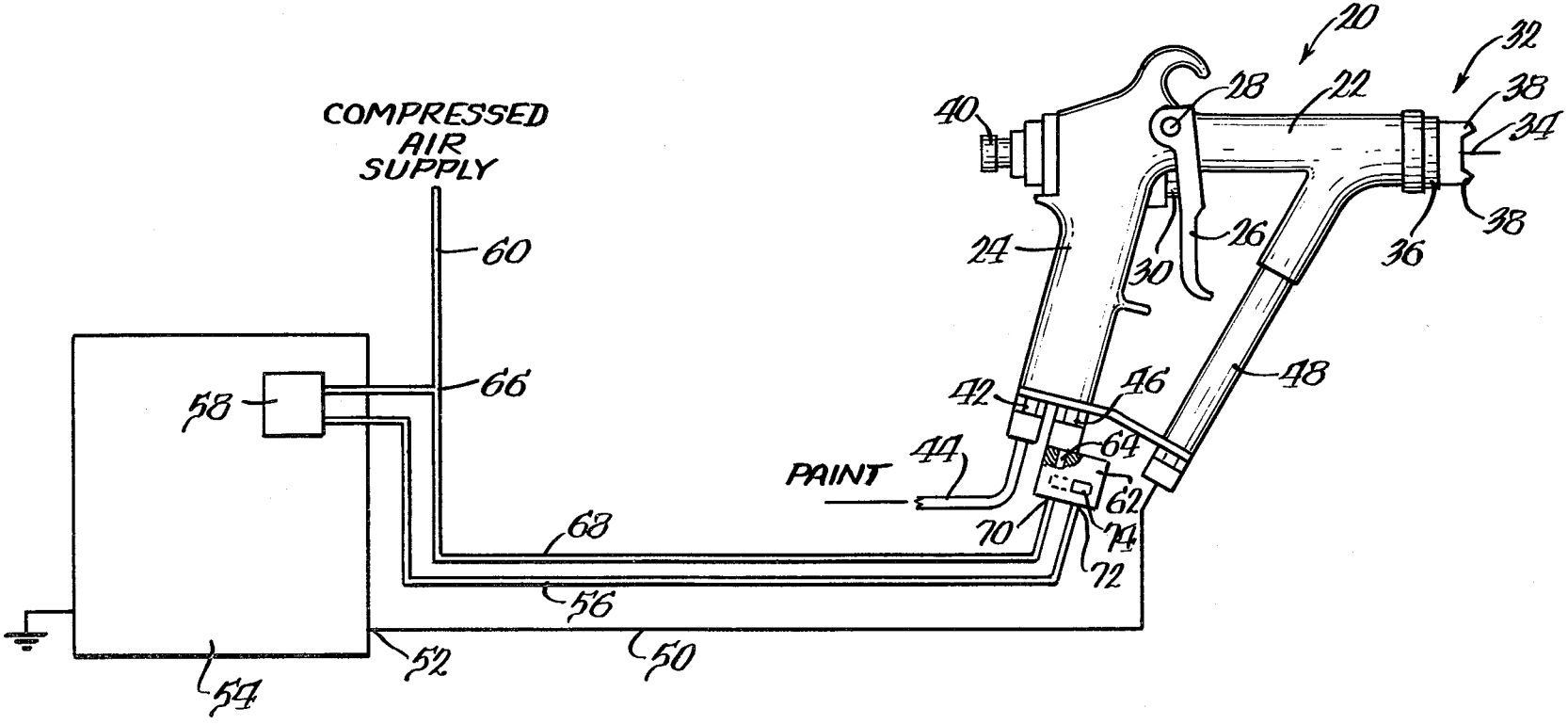
PAINT
COMPRESSED AIR SUPPLY

ELECTROSTATIC AIR ATOMIZATION SPRAY COATING SYSTEM

BACKGROUND OF THE INVENTION

The present invention relates to spray coating systems, and in particular to an electrostatic air atomization spray coating system having a hand held spray gun, wherein energization of a power supply for electrostatically charging spray particles may be controlled from the spray gun itself to selectively permit air atomization spraying with or without electrostatics.

In electrostatic air atomization spray coating systems, paint is applied to ware by means of a spray gun which atomizes the paint into a spray and includes a circuit which applies an electrostatic charge to the spray particles. Typically, the ware is grounded so that charged spray particles are attracted to and tend to uniformly cover all exposed areas of the ware. Electrostatic charging of the spray particles is usually accomplished by contacting the spray with an electrode as the spray is emitted, and to this end the electrode is maintained by a high voltage power supply at a voltage which may range from several thousand to 100,000 volts.

In conventional electrostatic air atomization spray coating systems using hand held spray guns, for reasons of safety it is desirable that the power supply be deenergized when spraying is not occurring, so that a high voltage is not then present at the charging electrode on the gun. It is also desirable that deenergization of the power supply occur automatically without overt action by an operator, so that each and every time spraying is terminated, voltage is removed from the electrode. To this end, the flow of atomizing air to the gun, which occurs when the gun is triggered on, is sensed by an air flow sensor for controlling energization of the power supply, the arrangement being such that when the gun is triggered on and a flow of air occurs, the power supply is energized, and when the gun is triggered off and the flow ceases, the power supply is deenergized. Such air flow sensors and their use in controlling power supplies in air atomization electrostatic spray coating systems are known in the art, and two representative sensors and systems employing the same are taught by Croskey et al U.S. Pat. No. 2,916,576 and Kozinski et al U.S. Pat. No. 3,864,603.

A disadvantage of systems of the foregoing type is that whenever the gun is triggered on, the power supply is energized. Consequently, when articles being painted have, for example, inside corners, it is difficult to perform final touch up work because of electrostatic charging of the spray, it being known that electrostatically charged spray particles are much more strongly attracted to side walls defining an inside corner, rather than into the corner itself. Usually, to perform such touch up work an operator must first turn off the power supply by means of a switch thereon, so that the power supply will not be energized when the gun is triggered on, which is inconvenient because he must leave the work area and walk over to the power supply to turn it off, and then return to the power supply to turn it back on when touch up is completed.

OBJECT OF THE INVENTION

A primary object of the present invention is to provide an improved air atomization electrostatic spray coating system using a hand held spray gun, wherein energization of a power supply for the gun may be controlled at the gun itself to permit air atomization spraying with or without electrostatics.

SUMMARY OF THE INVENTION

In accordance with the present invention, in an air atomization electrostatic spray coating system using a hand held spray gun, wherein a flow of atomizing air to the gun is sensed by an air flow sensor for controlling energization of a high voltage power supply for a charging electrode on the gun, the arrangement being such that when the gun is triggered on and air flow occurs the power supply is energized, and vice versa, there is provided an air bypass valve at the spray gun itself, which may be manipulated by an operator to selectively permit air atomization spraying with or without electrostatics.

The foregoing and other objects, advantages and features of the invention will become apparent upon a consideration of the following detailed description, when taken in conjunction with the accompanying drawing.

BRIEF DESCRIPTION OF THE DRAWING

The single drawing FIGURE illustrates an air atomization electrostatic spray coating system having a hand held spray gun, which in accordance with the teachings of the present invention includes an air bypass valve on the spray gun itself for selectively controlling energization of a remote high voltage power supply for the gun in response to triggering of the gun.

DETAILED DESCRIPTION

Referring to the drawing, there is shown an air atomization electrostatic spray coating system having a hand held spray gun, indicated generally at 20. The spray gun has a forward barrel or body portion 22 of electrically insulating material and a grounded handle 24 of electrically conductive material. A trigger 26 is pivotally mounted on the handle by means of a pin 28 for movement between a gun on position toward the handle and a gun off position away from the handle, and an air valve means 30 and a fluid valve means (not shown) are operably connected with the trigger to control a flow of air and coating material through the gun for emission from a forward spray head 32 when the gun is triggered on. The spray head has at its forward end a fluid outlet orifice (not shown) through which coating material is emitted and a charging electrode 34 extending through the orifice forwardly of the gun. To atomize into a spray coating material emitted from the orifice, an annular atomizing air opening (not shown) surrounds the orifice to atomize material emitted therefrom into a conical shaped spray, and to form the conical spray into a fan-shaped pattern, an air cap 36 has a pair of ears 38 through which opposed jets of air are directed against the conical spray on opposite sides thereof. A fluid valve adjustment knob 40 and an air valve adjustment knob (not shown) control the flow rates of coating material and air through the gun when the gun is triggered on.

Coating material or paint under pressure is provided at a coating material inlet 42 to the gun through a supply line 44, and air under pressure is provided at an air inlet 46. To develop a high voltage at the charging electrode 34 to electrostatically charge spray particles, the electrode is connected through a relatively large value safety resistor (not shown) within an insulating material sleeve 48 of the gun and through a high voltage cable 50 with an output 52 from a high voltage power supply 54, thereby to develop at the electrode an electrostatic charging voltage which may be from about 30,000 to 100,000 volts.

In view of the magnitude of the charging voltage at the electrode 34, for safety reasons the voltage is removed when the gun is triggered off and not in use, thereby to protect personnel against potential harm from accidentally contacting the electrode. To this end, the air inlet 46 to the gun receives air under pressure through a line 56, and the line is coupled through an air flow sensor and switch 58 with a line 60 leading to a supply of compressed air (not shown). The air flow sensor and switch, which advantageously is located in and forms a part of the power supply 54, may be of a type as taught by said aforementioned U.S. Pat. No. 2,916,576 to Croskey et al or any other conventional type as is known in the art, and controls energization of the power supply in response to a sensed flow of air therethrough. The arrangement is such that when the gun is triggered on and a flow of air to the gun occurs, the power supply is energized to develop an electrostatic charging voltage at the electrode, and when the gun is triggered off and the flow of air ceases, the power supply is deenergized to remove the voltage from the electrode.

To the extent described the system is conventional and, if a main power switch (not shown) on the power supply 54 is left on, whenever the gun is triggered on the air flow sensor and switch 58 will energize the power supply to develop an electrostatic charging voltage at the electrode 34, and whenever the gun is triggered off the power supply will be deenergized. The system therefore affords a measure of safety, since a high voltage is present at the electrode only during spraying. However, a disadvantage is that the air flow sensor and switch always energizes the power supply when the gun is triggered on, so that when articles being painted have, for example, a geometry which defines inside corners, it is difficult to perform final touch up work since electrostatically charged spray particles are much more strongly attracted to side walls defining an inside corner than to the corner itself. Therefore, to perform touch up work without electrostatics, an operator must turn off the main power switch for the power supply, so that the power supply will not be energized when the gun is triggered on. Considering that the power supply is usually located some distance from the work area, the procedure is inconvenient and time consuming since the operator must leave the work area to turn off the power supply and then return to the work area to perform the touch up work and, when touch up is completed, go back to the power supply to turn it on and again return to the work area.

In improving upon conventional systems of the general type, the invention provides a bypass valve 62 at the spray gun, which may be manually manipulated by an operator so that a flow of air to the gun either passes through, or bypasses, the air flow sensor and switch 58 for the power supply, thereby to selectively permit air atomization spraying with or without electrostatics. The bypass valve is carried by the spray gun itself, and has an outlet 64 connected with the air inlet 46 to the gun. The incoming air line 60 is connected both with an inlet to the air flow sensor and switch and, by means of a "T" connection 66, through a bypass line 68 with a first inlet 70 to the bypass valve, and an outlet from the air flow sensor and switch is connected through the line 56 with a second inlet 72 to the valve. The bypass valve, which may be a shuttle valve or any other type of conventional valve or valves, is provided with a lever 74 which is manipulatable between a first position, as shown, connecting the inlet 72 and the line 56 with the outlet 64, and a second position connecting the inlet 70 and the line 68 with the outlet. For normal spray painting operations, with the shuttle valve in its first position, incoming air flows through the air flow sensor and switch, whereby whenever the spray gun is triggered on the power supply is energized. However, should the geometry of the ware be such that it may advantageously be painted or touched up without electrostatics, the operator simply places the bypass valve lever in its second position, so that when the gun is triggered on, incoming air bypasses the air flow sensor and switch and the power supply remains deenergized. Consequently, the operator may conveniently control energization of the power supply, for electrostatic or nonelectrostatic spraying, at the spray gun itself and without need to leave the work area.

While one embodiment of the invention has been described in detail, various modifications and other embodiments thereof may be devised by one skilled in the art without departing from the spirit and scope of the invention, as defined in the appended claims.

What is claimed is:

1. In an air atomization electrostatic spray coating system having a hand held spray gun, of the type wherein a flow of atomizing air to said gun is sensed by an air flow sensor for controlling energization of a high voltage power supply for a charging electrode on said gun, the arrangement being such that when the gun is triggered on and an air flow occurs the power supply is energized, and vice versa, the improvement comprising a bypass valve which is manually manipulatable to selectively bypass a flow of air to said gun around said air flow sensor to permit air atomization spraying with and without electrostatics.

2. In a system as in claim 1, wherein said bypass valve is mounted on said spray gun.

3. In a spray coating system of the type including a hand held air atomization electrostatic spray gun having a coating material inlet for connection with a supply of coating material, an air inlet for connection through a line with a supply of air under pressure, and a charging electrode; a high voltage power supply having an output electrically connected with said electrode and energizable to apply a high voltage to said electrode; and an air flow sensor coupled with said line and with said power supply for sensing the presence or absence of a flow of air through said line in response to said spray gun being turned on or off and for respectively energizing or deenergizing said power supply in response thereto, the improvement comprising bypass valve means coupled with said line for connecting air in said line with said air inlet to said gun and manually manipulatable between a first position whereat said line is, and a second position whereat said line is not, coupled with said air flow sensor, whereby when said bypass valve means is in said first position said power supply is, and when in said second position said power supply is not, energized to apply a high voltage to said electrode when said gun is turned on.

4. In a spray coating system as in claim 3, wherein said bypass valve means is mounted on said spray gun.

5. In a spray coating system as in claim 3, wherein air in said line flows through said air flow sensor for being sensed thereby when said bypass valve means is in said first position, but bypasses said air flow sensor when said bypass valve means is in said second position.

6. In a spray coating system as in claim 3, wherein said air flow sensor is mounted on said power supply, said bypass valve means is mounted on said spray gun and said power supply is remote from said spray gun.

7. In a spray coating system as in claim 3, wherein said bypass valve means comprises a shuttle valve.

8. In a spray coating system as in claim 3, wherein said bypass valve means is mounted on said spray gun and has an outlet coupled with said spray gun air inlet and first and second inlets, said bypass valve means first inlet and outlet being connected when said bypass valve means is in said first position and said bypass valve means second inlet and outlet being connected when said bypass valve means is in said second position, said air flow sensor having an inlet connected with said line and an outlet connected with said bypass valve means first inlet, and including a bypass line connected between said air flow sensor inlet and said bypass valve means second inlet, whereby when said bypass valve means is in said first position and said spray gun is turned on air flows through said air flow sensor to said spray gun for energizing said power supply, and when said bypass valve means is in said second position and said spray gun is turned on air flows around said air flow sensor and through said bypass line to said spray gun and said power supply is not energized.

* * * * *